US006286948B1

(12) United States Patent
Wu et al.

(10) Patent No.: US 6,286,948 B1
(45) Date of Patent: Sep. 11, 2001

(54) INK-JET CARTRIDGE WITH A NEGATIVE PRESSURE INK RESERVOIR

(75) Inventors: Ji-chen Wu; Shih-hung Lee; Hsien-shu Tsai, all of Hsinchu (TW)

(73) Assignee: Wisertek International Corp., Hsinchu (TW)

( * ) Notice: Subject to any disclaimer, the term of this patent is extended or adjusted under 35 U.S.C. 154(b) by 0 days.

(21) Appl. No.: 09/489,951

(22) Filed: Jan. 24, 2000

(30) Foreign Application Priority Data

Sep. 9, 1999 (TW) ..... 088215571

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,409,134 * 4/1995 Cowger et al. ..... 222/1
5,691,755 * 11/1997 Pawlowski et al. ..... 347/86
5,767,882 * 6/1998 Kaplinsky et al. ..... 347/87
5,821,965 * 10/1998 Oda et al. ..... 347/86
6,053,606 * 4/2000 Yamaguchi et al. ..... 347/86
6,220,702 * 4/2001 Nakamura et al. ..... 347/86

* cited by examiner

*Primary Examiner*—N. Le
*Assistant Examiner*—Michael Nghiem
(74) *Attorney, Agent, or Firm*—Birch, Stewart, Kolasch & Birch, LLP

(57) ABSTRACT

An ink-jet cartridge with a negative pressure ink reservoir includes a rigid body provided with an ejecting device; an ink reservoir provided within the rigid body, the ink reservoir including two relatively movable plates and a plate body having resilience. The plate body is provided between the two flat plates, and is sealed with the circumferences of the two flat plates to form an enclosed ink reservoir. During ink-jet printing, the pressure within the ink reservoir decreases and the two plates move closer to each other to compress the plate body and the resilience of the plate body causes a negative pressure within the ink reservoir that prevents ink leakage from the ink-jet cartridge.

7 Claims, 3 Drawing Sheets

INK-JET CARTRIDGE WITH A NEGATIVE PRESSURE INK RESERVOIR

FIELD OF THE INVENTION

The present invention relates to an ink-jet cartridge for an ink-jet printing apparatus, and in particular, to an ink-jet cartridge with a negative pressure ink reservoir that provides a negative pressure by the resilience of the ink reservoir itself to prevent ink leakage from the ink-jet cartridge.

BACKGROUND OF THE INVENTION

An ink cartridge structure for a conventional ink-jet printing apparatus, as disclosed in U.S. Pat. No. 5,409,134, provides a fluid pressure regulating element in the ink reservoir for controlling the back pressure within an operating range that is suitable for preventing ink leakage while permitting the ejecting device to eject ink drops during printing. As shown in this prior patent, the fluid pressure regulation in the rigid ink reservoir can be controlled by flexible bags that are mounted to a curved spring. The pressure within the rigid ink reservoir drops instantly as the ink is ejected from the rigid ink reservoir via the ejecting device. At this moment, the atmosphere pressure is larger than the pressure within the rigid ink reservoir. Thus, ambient air will flow into the flexible bag so that the ink can be ejected smoothly while printing. Moreover, the expansion of the bag causes the deflection of the adjacent springs and thus decreases the ink pressure in the ink reservoir so that the zero ink leakage effect during printing can be achieved.

In another ink cartridge for an ink-jet printing apparatus, for example, the ink cartridge disclosed in U.S. Pat. No. 5,767,882, in order to avoid ink leakage in the process of ink-jet printing, a pressure regulating element is usually provided in the ink reservoir for keeping the pressure within the ink reservoir at a negative pressure so that there is no ink leakage in the printing process.

However, in both of these prior art ink-jet cartridges, a pressure regulating means has to be provided in the ink-jet cartridge and this causes the complexity in structure and assembly of the ink-jet cartridge.

SUMMARY OF THE INVENTION

It is accordingly an object of the invention to provide an ink-jet cartridge with a negative pressure ink reservoir that is simple in structure and easy to assemble. Thereby, the manufacturing cost of the ink-jet cartridge can be reduced.

Another object of the invention is to provide an ink-jet cartridge with a negative pressure ink reservoir that generates a negative pressure during ink-jet printing so that ink leakage from the ink-jet cartridge can be prevented.

To achieve the above objects, an ink-jet cartridge with a negative pressure ink reservoir of the invention comprises: a rigid body provided with an ejecting device; an ink reservoir provided within the rigid body, the ink reservoir including two relatively movable plates and a negative pressure means. The negative pressure means is embodied as a plate body having resilience, is provided between the two flat plates, and is sealed with the circumferences of the two flat plates to form an enclosed ink reservoir.

Thus, during ink-jet printing, the pressure within the ink reservoir decreases and the two plates move closer to each other to compress the plate body and the resilience of the plate body causes a negative pressure within the ink reservoir that prevents ink leakage from the ink-jet cartridge.

BRIEF DESCRIPTION OF THE DRAWINGS

The above and other objects and advantages of the present invention will become apparent by reference to the following description and accompanying drawings wherein.

DETAILED DESCRIPTION OF THE PREFERRED EMBODIMENT

Figure 1:
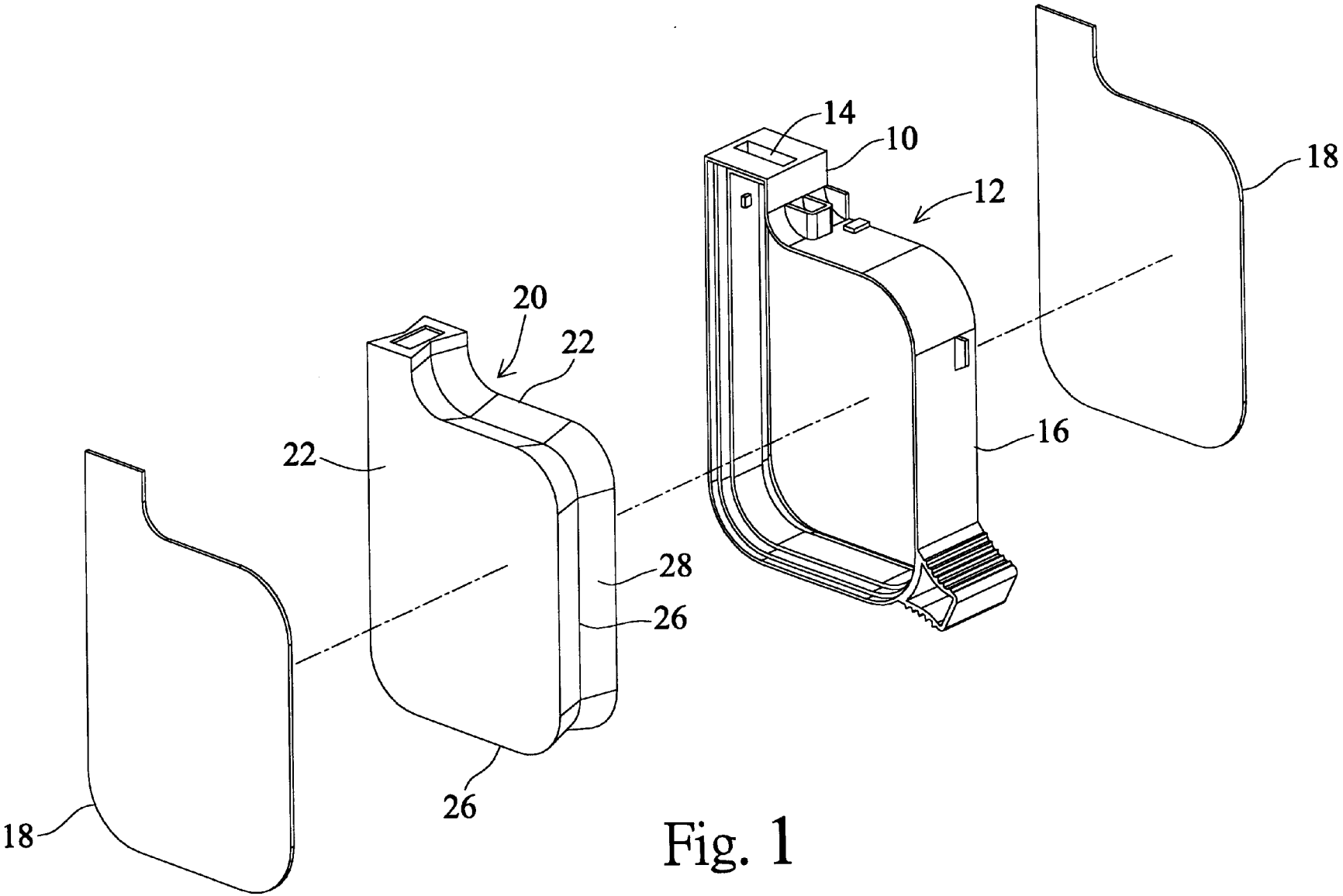
FIG. 1 is an exploded view of an ink-jet cartridge with a negative pressure ink reservoir in accordance with a preferred embodiment of the invention.
Figure 2:
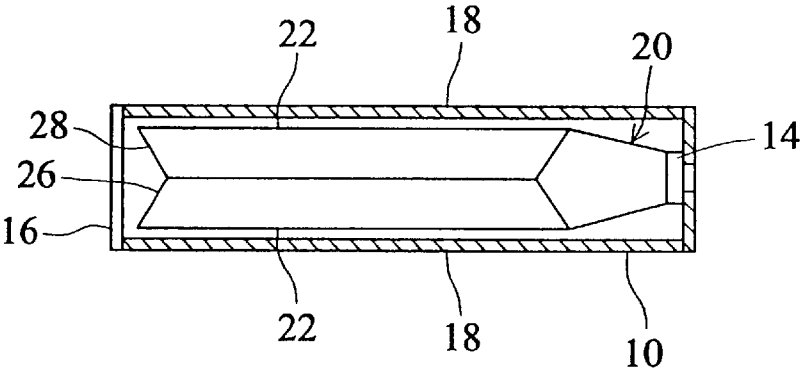
FIG. 2 is a sectional view showing an ink-jet cartridge with a negative pressure ink reservoir as shown in FIG. 1.

Referring to FIGS. 1 and 2, an ink-jet cartridge with a negative pressure ink reservoir in accordance with a preferred embodiment of the invention comprises a rigid body 12 having an output port 10 on which is mounted an ejecting device 14 for ejecting the ink from the ink-jet cartridge during printing. The ejecting device 14 can be either of the hot vapor bubble type or of the piezoelectric type.

The rigid body 12 includes a hollow frame 16 and two cover plates 18 that cover the two sides of the hollow frame 16 respectively to form an enclosed space.

An ink reservoir 20 for holding ink is provided in the rigid body 12 and is in communication with the output port 10 so that the ejecting device 14 can eject the ink from the ink reservoir 20. The ink reservoir 20 includes two relatively movable flat plates 22 and a negative pressure means that is embodied as a plate body 28 having at least a crease 26. The plate body 28 is positioned between the two flat plates 22 and is sealed with the circumferences of the two flat plates to form an enclosed ink reservoir 20. Thus, when the ink reservoir 20 is compressed and then released, a negative pressure is generated in the ink reservoir 20 by the resilience thereof. The two flat plates 22 and the plate body 28 can also be integrally formed, for example by a plastic injection molding process.

Figure 4:
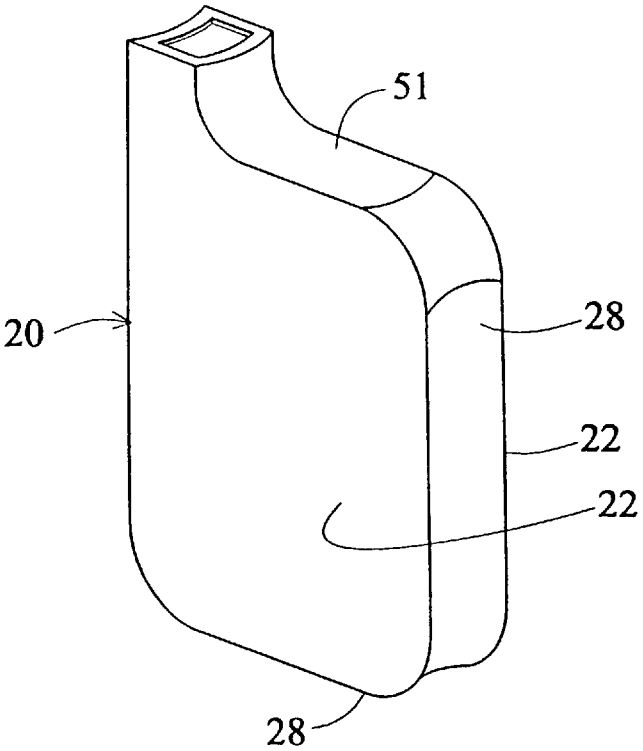
FIG. 4 is a pictorial view showing a negative pressure ink reservoir in accordance with another preferred embodiment of the invention.
Figure 3:
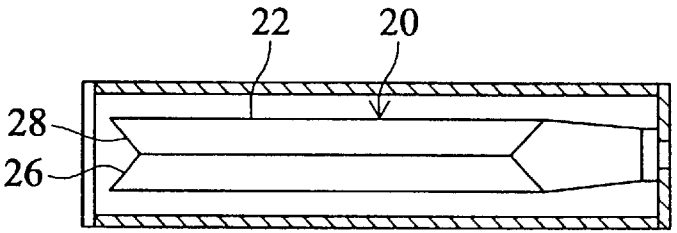
FIG. 3 is a sectional view showing that the negative pressure ink reservoir as shown in FIG. 2 is in a compressed state.

Referring to FIG. 3, when the ink within the ink reservoir 20 is ejected for printing, the ambient pressure pushed the two flat plates 22 closer and the plate body 28 having at least a crease is deformed. A negative pressure is generated within the ink reservoir 20 by the resilience of the plate body 28. The negative pressure prevents ink leakage from the ink-jet cartridge. Moreover, the plate body 28 can have an arc-shaped surface as shown in FIG. 4 and has resilience when it is deformed.

Figure 5:
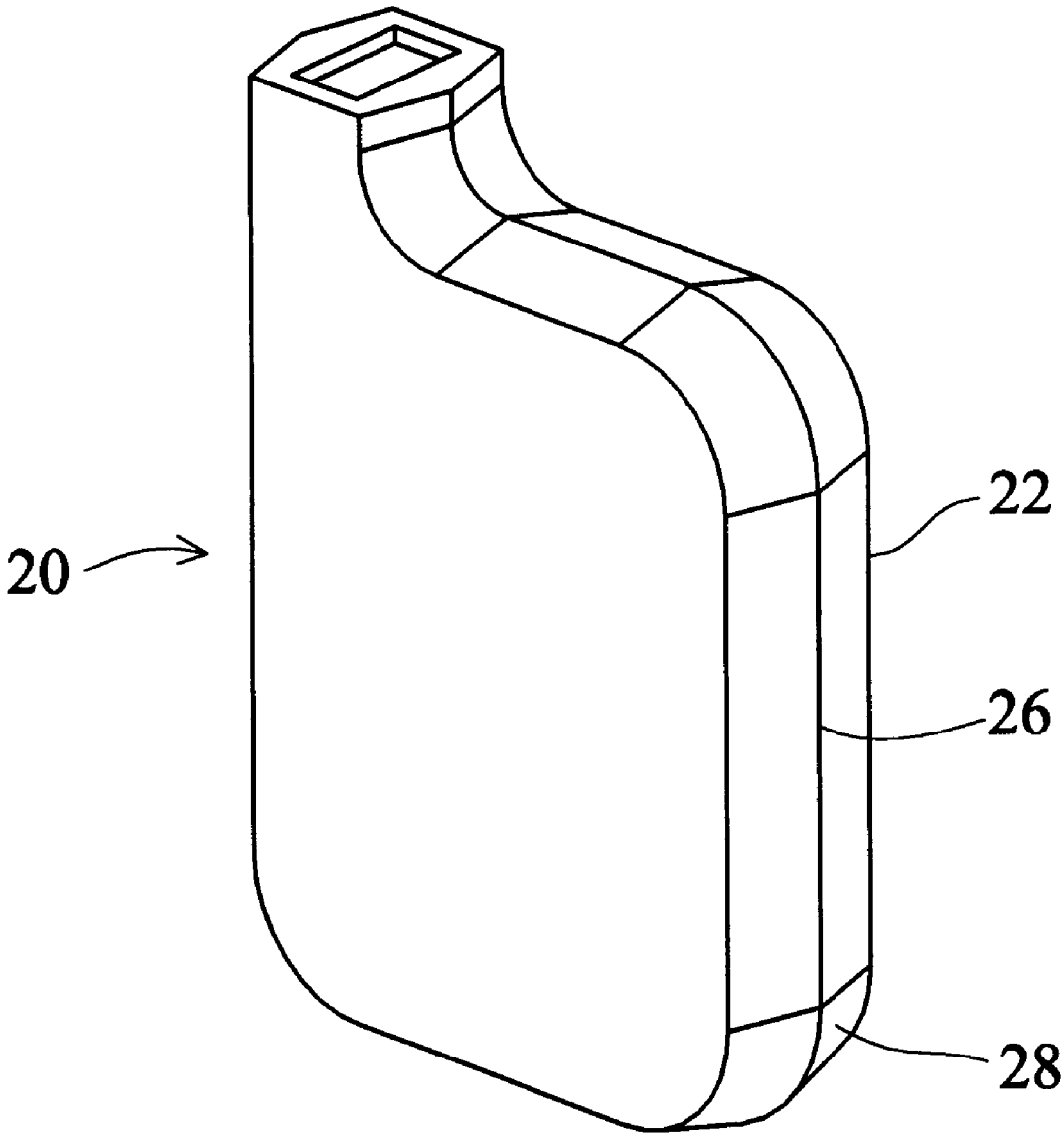
FIG. 5 is a pictorial view showing a negative pressure ink reservoir in accordance with yet another preferred embodiment of the invention.

Referring to FIG. 5, a plate body 28 is assembled between two flat plates 22 and the crease on the plate body 28 extends outward beyond the circumferences of the two flat plates 22. With respect to this structure, when the ink within the ink reservoir 20 is about to be exhausted, the two flat plates 22 can be substantially pressed together and all the ink within the ink reservoir 20 can be ejected without any ink left.

Therefore, an ink-jet cartridge with a negative pressure ink reservoir of the invention can generate a negative pressure within the ink reservoir by the resilience of the ink reservoir itself to prevent ink leakage from the ink-jet cartridge. Moreover, no additional negative pressure is needed in the ink-jet cartridge. Obviously, this helps to reduce the manufacturing cost and assembling cost. An ink reservoir integrally formed by plastic injection molding is even easier to manufacture.

While the invention has been described by way of example and in terms of three preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An ink-jet cartridge with a negative pressure ink reservoir comprising:

a rigid body provided with an ejecting device mounted on a first end of the rigid body for ejecting ink; and said negative pressure ink reservoir provided within the rigid body, the ink reservoir including two relatively movable flat plates and an elastic plate body positioned between the two flat plates, the elastic plate body being sealed with the circumferences of the two plates to form an enclosed ink reservoir.

2. An ink-jet cartridge with a negative pressure ink reservoir according to claim 1, wherein the rigid body is provided with an ink output port and the ejecting device is mounted on the ink output port.

3. An ink-jet cartridge with a negative pressure ink reservoir according to claim 1, wherein the rigid body includes a hollow frame and two cover plates sealed with the hollow frame.

4. An ink-jet cartridge with a negative pressure ink reservoir according to claim 1, wherein the two flat plates and the elastic plate body of the ink reservoir are integrally formed.

5. An ink-jet cartridge with a negative pressure ink reservoir according to claim 4, wherein the two flat plates and the plate body of the ink reservoir are integrally formed from a plastic material.

6. An ink-jet cartridge with a negative pressure ink reservoir according to claim 1, wherein the plate body of the ink reservoir has at least one crease.

7. An ink-jet cartridge with a negative pressure ink reservoir according to claim 1, wherein the plate body of the ink reservoir is in an arc-shaped form.

* * * * *